United States Patent [19]

Suwa

[11] Patent Number: 4,858,656

[45] Date of Patent: Aug. 22, 1989

[54] APPARATUS FOR REMOVING A FAULTY WEFT ON A JET LOOM

[75] Inventor: Mitsuru Suwa, Ishikawa, Japan

[73] Assignee: Tsudakoma Kogyo Kabushiki Kaisha, Japan

[21] Appl. No.: 222,129

[22] Filed: Jul. 21, 1988

Related U.S. Application Data

[63] Continuation-in-part of Ser. No. 934,730, Nov. 25, 1986, abandoned.

[30] Foreign Application Priority Data

Jan. 27, 1986 [JP] Japan ..... 61-16166

[51] Int. Cl.[4] ..... D03D 47/28; D03J 1/00

[52] U.S. Cl. ..... 139/116; 139/435

[58] Field of Search ..... 139/1 R, 116, 435, 450

[56] References Cited

U.S. PATENT DOCUMENTS

| | | | |
|---|---|---|---|
| 3,805,850 | 4/1974 | Dunyhoven et al. | 139/1 E |
| 4,502,512 | 3/1985 | Suzuki et al. | 139/116 |
| 4,658,866 | 4/1987 | Takegawa et al. | 139/450 |
| 4,749,006 | 6/1988 | Miyamoto | 139/1 R |

*Primary Examiner*—Henry S. Jaudon

*Attorney, Agent, or Firm*—Lerner, David, Littenberg, Krumholz & Mentlik

[57] ABSTRACT

A faulty weft connected to the main jet nozzle of a loom is caught by a swingable hook pin and wound on a take-up drum arranged in front of the main jet nozzle. A cutter reciprocates into an opening provided in the path of the wound faulty weft to severe same from the weft supply. The faulty weft is removed by suction through an adjacent suction pipe.

9 Claims, 2 Drawing Sheets

APPARATUS FOR REMOVING A FAULTY WEFT ON A JET LOOM

BACKGROUND OF THE INVENTION

This is a continuation-in-part application of copending application Ser. No. 934,730 filed on Nov. 25, 1986.

The present invention relates to an apparatus for removing a faulty weft on a jet loom, and more particularly, relates to improvements in automatic removal of a faulty weft, i.e., an incompletely inserted weft such as a broken weft on a fluid jet loom.

One conventional apparatus for removing a faulty weft is proposed in Japanese Patent Opening Sho. 59-21757. This conventional apparatus is constructed of a main remover unit and an auxiliary remover unit which assigns a faulty weft taken from the shed to the main remover unit. With this construction, however, weft assignment between the cooperating unit is liable to end in failure, thereby preventing correct removal of the faulty weft. In addition, use of two cooperating units results in a complicated construction and difficult operational synchronization, thereby raising the production cost and increasing maintenance work.

SUMMARY OF THE INVENTION

It is an object of the present invention to achieve automatic removal of a faulty weft with high operational reliability, simple construction and easy maintenance.

In accordance with the basic concept of the present invention, a take-up drum having a radial hook pin is arranged above and just in front of the main jet nozzle so that, at faulty weft insertion, the hook pin can swing to capture a faulty weft connected to the main nozzle and wind same on the take-up drum.

BRIEF DESCRIPTION OF THE DRAWINGS

The above description, as well as further objects, features and advantages of the present invention will be more fully understood with reference to the following detailed description of a presently preferred, but nonetheless illustrative, apparatus for removing a faulty weft on a jet loom, when taken in conjunction with the accompanying drawings, wherein.

DESCRIPTION OF THE PREFERRED EMBODIMENTS

Figure 1:
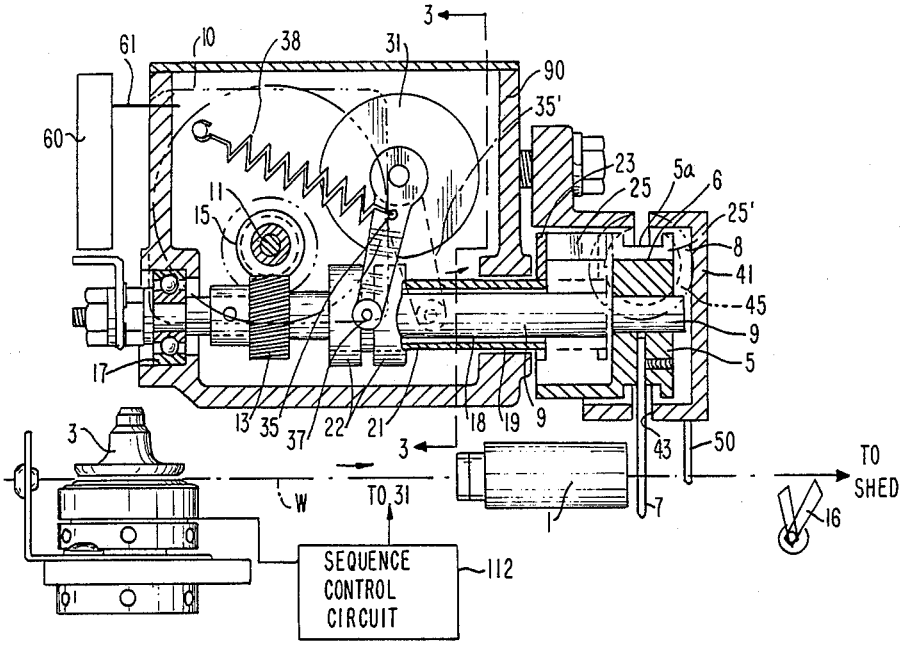
FIG. 1 is a side view, partly in section, of one embodiment of the apparatus in accordance with the present invention.
Figure 2:
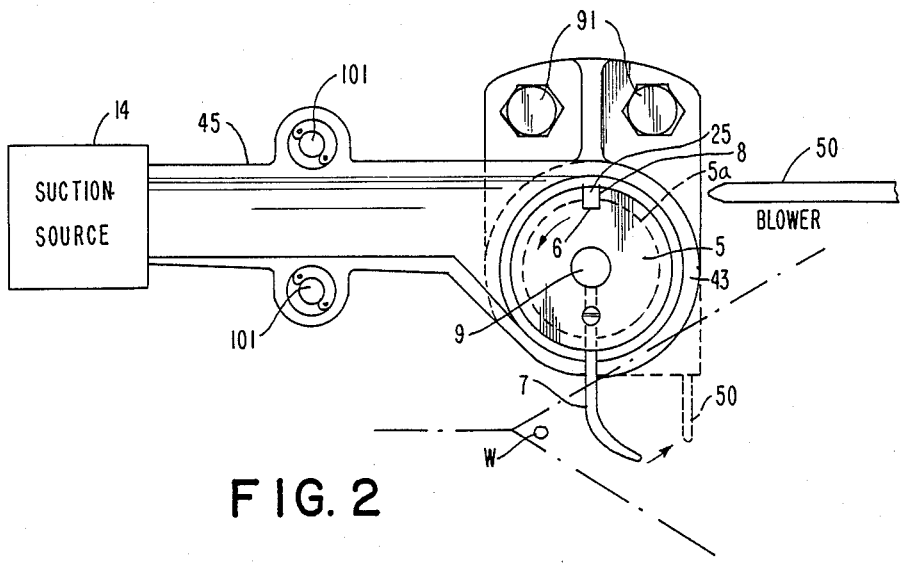
FIG. 2 is a front view, partly in section, of the apparatus shown in FIG. 1, having a suction cover removed for clarification.
Figure 3:
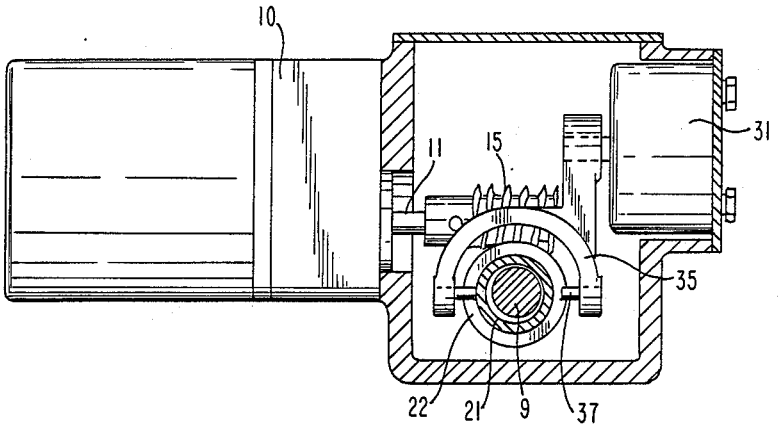
FIG. 3 is a cross-sectional view, partly in section, taken along line 3—3 in FIG. 1.

As shown in FIGS. 1 to 3, the apparatus includes a take-up drum 5 arranged in front of and above the ejection mouth of a main jet nozzle 1. The take-up drum 5 rotates in a direction normal to the running direction of a weft W to be inserted in a shed by ejection of the main jet nozzle 1. The take-up drum 5 is secured to the front end of a rotary main shaft 9 which extends parallel to the weft running direction and is supported by a bearing 17 mounted to a housing 90 of the apparatus. Near the bearing 17, the main shaft 9 carries a worm gear 13 in meshing engagement with a worm 15. The worm 15 is secured to the output shaft 11 of a drive motor 10 which starts rotation on receipt of a prescribed signal. Rotation of the drive motor 10 is transmitted to the main shaft 9 via the elements 13 and 15 in order to rotate the take-up drum 5 in a direction to separate a faulty weft from the clothfell, i.e., in the counterclockwise direction in FIG. 2.

When the length of one pick (one cycle insertion) weft is equal to L, the diameter of the weft winding section on the take-up drum 5 is equal to D and the percent transmission of rotation from the motor shaft to the drum is equal to K, the following relation applies since even a faulty weft has the same length as a regularly inserted weft $$\pi DKN \geqq L$$

$$\therefore N \geqq L/\pi DK$$

To this end, a timer is attached to the drive motor 10 so that supply of power to the drive motor should be stopped at a prescribed moment after starting of the motor. In practice, such a moment can be obtained by measuring the length of the period necessary for reaching the abovedescribed number of rotation (N). That is, the moment is chosen beyond the end of such a moment.

The take-up drum 5 is provided with a peripheral groove 5*a* and a curved hook pin 7 projecting recessed radially outwards from the peripheral groove 5*a* towards the ejection mouth of the main jet nozzle 1. The size and shape of the hook pin 7 is chosen so that, when the takeup drum 5 rotates, the hook pin 7 will capture the section of a faulty weft extending between the ejection mouth of the main jet nozzle 1 and the shed.

After capture by the hook pin 7, the faulty weft is wound on the peripheral groove 5*a* of the take up drum 5. To this end, a hollow cylindrical cutter shaft 21 is inserted over the main shaft 9 in an axially slidable arrangement via a sleeve 18. The cutter shaft 21 is slidably supported by the housing 90 via a bushing 19. Near the take-up drum 5, a cutter 25 is mounted to the cutter shaft 21 via a cutter base 23 in an arrangement axially reciprocal along the outer peripheral surface of the take-up drum 5 through opening 8 as shown in FIG. 2.

Near the worm gear 13, a pair of axially spaced collars 22 are securedly inserted over the cutter shaft 21. A downwardly extending lever 35 is secured to the output shaft of a rotary actuator 31 mounted to the housing 90 and its lower end is coupled to the collars 22 on the cutter shaft 21 via a pivot 37. A return spring 38 is coupled at one end to the lever 35 and at the other end to the housing 90. When the actuator 31 rotates counterclockwise in FIG. 1 at a prescribed moment, the lever 35 swings towards the take-up drum 5 against the spring force so that the cutter 25 will advance into the region of the peripheral surface of the take-up drum 5 through opening 8 as shown in FIG 2. As the actuator 31 is deactivated, the spring force swings the lever 35 away from the take-up drum 5 so that the cutter 25 will recede from the region of the peripheral surface of the take-up drum 5.

In order to assist winding of the faulty weft W on the peripheral groove 5a of the take-up drum 5, the take-up drum 5 is preferably encased spacedly in a suction cover 41 which is connected to a suction source 14 via a pipe 45. The suction cover 41 is secured to pipe 45 for support thereof by bolts (not shown) extending through bolt holes 101. More specifically, the suction cover 41 as shown in FIG. 1 is constructed of two sections boarded by a slit 43. FIG. 2 shows a section taken along the plane of separation with suction cover 41 being removed. These two sections, i.e., suction cover 41 and pipe 45, are coupled to each other at the left hand portion by fastener bolts inserted into the upper and lower disclosed bolt holes 101, leaving the slit 43 to permit rotation of the hook pin 7. The slit 43 is formed in the lower section of the suction cover 41 in order to allow free swing of the hook pin 7. Although the suction cover 41 is not shown in FIG. 2, for clarification purposes, it should be apparent that the attaching of the suction cover to the pipe 45 permits the provision of the slit 43 through which pin 7 is allowed to rotate. In the case of a water jet loom, the suction system may be branched from an exhaust blower via a proper switch valve. Preferably a filter is arranged in the suction system, for example in the pipe 45, for easy separation of the removed faulty weft.

A clamper 3 is arranged on the upstream side of the main jet nozzle 1 in order to control weft supply to the main jet nozzle 1. A stopper pin 50, projects downwards from the lower section of the suction cover 41 in order to assist weft capture by the hook pin 7 by preventing rearward bias of the section of the faulty weft W extending between the main jet nozzle 1 and the shed. The hook pin 7 rotates about the center of the main shaft 9 while engaging the weft W at a location between the main jet nozzle 1 and the shed of the cloth-fell. As a consequence, the weft W assumes a V-shape profile. In the absence of stopper pin 50, the opening angle of the V-shape may be too large for the weft W to be successively received into slit 43 and the weft W might otherwise be wound only around the suction cover 41. The stopper pin 50 is used for avoiding this situation. That is, the stopper pin 50 catches the weft W to reduce the opening angle of the V-shape. As a consequence, the weft W caught by the hook pin 7 reliably enters the slit 43. To this end, the closer the stopper pin 50 is to the slit 43, the smaller the opening angle of the V-shape. As a result, the smaller the opening angle of the V-shape, the more reliable the entering of the weft W into the slit 43.

A proximity switch 60 is provided to pass a signal to the drive motor 10 via line 61 in order to place the hook pin 7 in a position so as not to disturb normal weft insertion. As to proximity switch 60, such switch is normally closed but is open when it faces the switch control pieces provided on the main shaft 9. When closed, the proximity switch 60 passes a signal to one input terminal of an AND-element in a stop circuit for the drive motor 10. The other input terminal of this AND-element is connected to the output terminal of a timer which delays a start signal for the drive motor 10. A stop signal for the drive motor 10 is generated, after the time lag set by the timer, when the switch controller piece on the main shaft 9 is not in a position facing the proximity switch 60. Accordingly, the hook pin 7, when stopped, does not come to the position shown in FIG. 2, i.e., a position to impede weft insertion. When inertia rotation disturbs the stop position, the mounting angle of the switch controller piece to the main shaft 9 may be accordingly adjusted.

With the above-described construction, the apparatus operates as follows. During normal weaving, the weft is supplied to the main jet nozzle 1 via the open clamper 3 for insertion into open sheds. A stop signal is generated in a known way, should faulty weft insertion be detected. On generation of a stop signal, the weft cutter 16 and the clamper 3 are provisionally made inactive in order not to sever the faulty weft, the next weft insertion is inhibited and the loom ceases running after about one cycle of inertia running. That is, the faulty weft is kept in connection with the main jet nozzle 1 when the loom has stopped. Examples of a weft cutter 16 and a clamper 3 are disclosed in, for example, U.S. Patent Nos. 3,805,850 and 4,502,512. Operations of these elements, including reverse rotation of the loom, are controlled by a known control device such as the sequence control circuit 112 disclosed in U.S. Pat. No. 4,658,866. When a clamper 3 is normally spring loaded to open but provisionally electrically excited (for example a solenoid) to close, "an active condition" refers to the closed condition. On the other hand, when a clamper 3 is normally spring loaded to close but provisionally electrically excited to open, "an active condition" refers to the open condition. Accordingly, the clamper is opened to allow removal of weft from the reservoir. As for the timing to stop operation of the motor, this is based upon the parameters of the removal unit as discussed above with respect to the number of revolutions required for faulty weft removal.

Next, the loom is rotated reversely to a crank position of about 180 degrees in order to enable smooth removal of a faulty weft. The clamper 3 is returned to its active condition. Under this condition, the drive motor 10 starts rotation and the take-up drum 5 rotates counterclockwise in FIG. 2 so that the hook pin 7 will capture the faulty weft W to wind upon the peripheral groove 5a of the take-up drum 5.

By this swing of the hook pin 7, the faulty weft is separated from the cloth-fell without application of any malign force to the warps. As to the maligned force, when a faulty weft is entangled with, for example, a weft or wefts, impulsive force caused by abrupt pulling of the weft for removal can tend to cause breakage of the warp or warps. Even when there is no substantial entanglement, increased frictional force between the faulty weft and the warp or warps develops fluffs on the warps. Since weft insertion just next to the faulty weft is inhibited, the section of the weft of about one cycle left in the weft reservoir is removed concurrently.

The rotation speed of the drive motor 10 is adjustable in accordance with the design of the loom to be produced. This is because the speed of the weft removal will be chosen according to the design of the cloth for smooth weft removal. The drive motor 10 stops rotation when winding of the faulty weft is complete so that, at the moment of subsequent faulty weft cutting, the section of the weft connected to the main jet nozzle 1 will be cut at a position suited for restart of loom running by weft cutter 16.

Next, the actuator 31 is activated to swing the lever 35 towards the take-up drum 5, i.e., counterclockwise in FIG. 1, and the cutter shaft 21 moves towards the take-up drum 5 so that the cutter 25 should advance to a position shown with chain lines 25'. Operation control of the actuator 31 is carried out by, for example, the sequence control circuit 112 previously mentioned.

This advance of the cutter 25 transversely severs the faulty weft wound on the peripheral groove 5*a* of the take-up drum 5 as it enters opening 8 bound by lower surface 6. As more clearly shown in FIG. 2, the blade 25 extends below the surface of the groove 5*a* shown in dashed lines by being supported on lower surface 6 of opening 8. The blade 25 extends through the slotted opening designated by reference numeral 8. As a result, the forward end of the blade 25 severs the faulty weft wound about the surface of groove 5*a*. As the actuator 31 is deactivated, the lever 35 returns to its initial position due to the spring force so that the cutter 25 will recede from the region of the take-up drum 5. For reliable weft cutting, the system may be designed so that the cutter 25 is reciprocal for several times per one cycle of cutting. During this weft cutting, the clamper 3 will be kept closed in order to stretch the faulty weft at cutting.

The severed faulty weft is removed from the take-up drum 5 via the pipe 45 by pneumatic suction. Preferably the take-up drum 5 will be rotated at this moment for easy removal of the faulty weft. Thereafter, the loom is rotated reversely to a crank position suited for restart of running and all associated parts of the loom resume conditions ready for restart. The clamper 3 returns to its ordinary state and is, therefore, closed. After 180° reverse rotation of the loom, the clamper 3 is kept still inactive (open). During rotation of the hook pin 7, not only the faulty weft in the open shed but also the weft on the weft reservoir are taken up on the take-up drum 5 via the slit 43. The weft reservoir is also kept inactive during this period. Just before the weft cutting operation, the clamper 3 is returned to active (closed) state to inhibit issue of the weft W from the weft reservoir.

Figure 4:
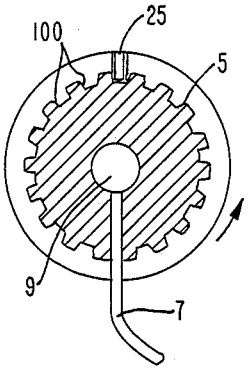
FIG. 4 is a fragmentary view of another embodiment of the apparatus in accordance with the present invention.
Figure 5:
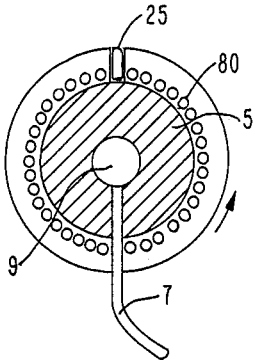
FIG. 5 is a fragmentary view of the other embodiment of the apparatus in accordance with the present invention.

When the present invention is applied to a water jet loom, a wet faulty weft tends to stick tightly to the surface of the take-up drum 5, thereby disenabling easy removal by pneumatic suction. An alternative embodiment of the present invention shown in FIG. 4 alleviates this problem of wetness by providing longitudinal slots 100 in the peripheral surface of the take-up drum 5. Reduced surface contact of the faulty weft with the take-up drum assists weft removal by pneumatic suction. For the same purpose, another embodiment of the present invention shown in FIG. 5 is provided with a take-up drum made of a number of parallel, spaced rods 80 which are arranged circularly about a common axis. This construction also reduces the extent of surface contact.

In addition to the pneumatic suction for weft removal from the take-up drum, air flow may be blown from a blower 50 to the surface of the take-up drum so that the faulty weft on the take-up drum will be driven towards the mouth of the pipe 45.

In accordance with the present invention, absence of weft of weft assignment allows weft removal with high operational reliability. Although the invention herein has been described with references to particular embodiments, it is to be understood that these embodiments are merely illustrative of the principles and application of the present invention. It is therefore to be understood that numerous modifications may be made to the embodiments and that other arrangements may be devised without departing from the spirit and scope of the present invention as defined by the dependant claims.

What is claimed is:

1. An apparatus for removing a faulty weft from a cloth-fell in the operation of a jet loom comprising a rotary take-up drum arranged above and in front of a main jet nozzle adapted for insertion of a weft into said cloth-fell, said take-up drum having a hook pin which radially extends outwardly, and positioning means for positioning, by rotation of said take-up drum, said hook pin at a first location out of moving ambit of a weft during normal running of said jet loom and at a second location to capture that portion of a faulty weft adjacent said main jet nozzle and to wind said faulty weft on said take-up drum upon rotation thereof, thereby removing said faulty weft from said cloth-fell.

2. The apparatus as claimed in claim 1 in which said positioning means includes a main shaft extending parallel to the axis of said main jet nozzle and concentrically carrying said take-up drum at one end thereof, and a drive motor for rotating said main shaft for removal of said faulty weft by said take-up drum.

3. The apparatus as claimed in claim 1 further comprising severing means for transversely severing said faulty weft wound on said take-up drum.

4. The apparatus as claimed in claim 3 in which said positioning means includes a main shaft extending parallel to the axis of said main jet nozzle and concentrically carrying said take-up drum at one end thereof, and a drive motor rotating said main shaft over a prescribed angle of rotation on receipt of a stop signal which is generated at faulty weft insertion, said severing means including a hollow cylindrical cutter shaft inserted over said main shaft in slidable arrangement, said shaft slidably supported by the housing of said apparatus, a cutter held by said cutter shaft in an arrangement projectable transversely into the region of the peripheral surface of said take-up drum and projecting means for projecting said cutter into said region.

5. The apparatus as claimed in claim 4 in which said projecting means includes an actuator having an output shaft and a lever mounted to the output shaft of said actuator and having a distal end pivotally coupled to said cutter shaft.

6. The apparatus as claimed in claim 1 further comprising a suction cover spacedly encasing said take-up drum, and a pneumatic suction source connected to the interior of said suction cover.

7. The apparatus as claimed in claim 1 in which said take-up drum has a plurality of longitudinal slots in its peripheral surface.

8. The apparatus as claimed in claim 1 in which said take-up drum is made up of a plurality of parallel rods which are spacedly and circularly arranged about a common axis.

9. The apparatus as claimed in claim 1 further comprising means for blowing air flow on the peripheral surface of said take-up drum.

* * * * *